US005887922A

United States Patent [19]

Hendrix et al.

[11] Patent Number: 5,887,922

[45] Date of Patent: Mar. 30, 1999

[54] ADJUSTABLE LIFTING BAIL FOR FLUID COMPRESSOR

[75] Inventors: Dean P. Hendrix, Mocksville, N.C.; Gordon M. Day, Manchester, England

[73] Assignee: Ingersoll-Rand Company, Woodcliff Lake, N.J.

[21] Appl. No.: 949,797

[22] Filed: Oct. 14, 1997

Related U.S. Application Data

[60] Provisional application No. 60/057,494 Sep. 4, 1997.

[51] Int. Cl.[6] ..... B66C 1/62

[52] U.S. Cl. ..... 294/67.5; 294/81.3

[58] Field of Search ..... 294/15, 67.21, 294/67.5, 81.2, 81.21, 81.3, 82.12, 86.41

[56] References Cited

U.S. PATENT DOCUMENTS

| | | | |
|---|---|---|---|
| 1,535,022 | 4/1925 | Jenkins | 294/81.3 |
| 2,703,252 | 3/1955 | Blackwell | 294/67.5 |
| 3,995,903 | 12/1976 | Ernst | 294/81.3 |
| 4,431,223 | 2/1984 | Miller | 294/67.5 |
| 4,597,602 | 7/1986 | McGriff | 294/67.5 |
| 4,936,616 | 6/1990 | Williams | 294/67.5 |

FOREIGN PATENT DOCUMENTS

| | | | |
|---|---|---|---|
| 276-273 | 2/1990 | Germany | 294/67.5 |

*Primary Examiner*—Dean Kramer
*Attorney, Agent, or Firm*—Michael M. Gnibus; Michael J. Doherty

[57] ABSTRACT

A lifting bail adapted to be made integral with a machine having a center of gravity includes a lift eye plate located substantially near the machine center of gravity, a first locator member having openings for locating the lift eye plate substantially near the machine center of gravity and a second locator member having openings for locating the lift eye plates substantially near the machine center of gravity. The openings for locating the lift eye plate relative to the center of gravity are oriented along the first and second locator members so that when the first and second locator members are made integral with the machine, the openings are aligned and thereby provide the location for the lift eye plates substantially near the machine center of gravity.

14 Claims, 7 Drawing Sheets

ADJUSTABLE LIFTING BAIL FOR FLUID COMPRESSOR

This application claims the benefit of U.S. Provisional Application Ser. No. 60/057,494, filed Sep. 9,1997.

BACKGROUND OF THE INVENTION

The invention generally relates to a lifting bail and more particularly, the invention relates to an adjustable lifting bail for a fluid compressor where at least one dimension of the lifting bail may be altered to locate the lifting bail lifting aperture substantially near the center of gravity for the fluid compressor. As a result, the lifting bail of the present invention may be used in combination with a variety of different compressors.

In order to transfer heavy equipment or machinery during assembly or shipment, such heavy equipment or machinery such as air compressors and generators, for example typically include a single point lifting bail for conveniently handling the machinery using overhead hoists or cranes. It is beneficial to locate the single point lifting bail at or substantially near the center of gravity of the machine so that the machine is maintained at a level attitude during lifting. Additionally, if the single point lifting bail is located off the machine's center of gravity, undesirable stresses may be imparted to the machine components during lifting.

Conventional lifting bails are typically fixed to the machine frame and include means for receiving a hook or other connection member connected to the end of the hoist or crane. Such a conventional lifting bail is designed so that the hook receiving means is located at or above the corresponding center of gravity or center of mass for a particular machine. Because each machine or piece of equipment has a unique center of gravity, each lifting bail must be custom designed specifically for use in combination with a single particular machine.

Custom designing a lifting bail for each piece of equipment has the following associated shortcomings. First, valuable engineering time is spent: designing each of the lifting bails, building and analyzing prototypes of each lifting bail, and testing and qualifying each lifting bail design. Additionally, because unique lifting bails are required for each piece of machinery, a number of different lifting bails must be available for use and as a result, the required lifting bail parts inventory may be quite large.

The foregoing illustrates limitations known to exist in present lifting bails for machinery. Thus, it is apparent that it would be advantageous to provide a lifting bail that overcomes these limitations. Accordingly, a suitable alternative lifting bail is provided including features more fully disclosed hereinafter.

SUMMARY OF THE INVENTION

The present invention is a lifting bail adapted to be made integral with a machine having a center of gravity, the lifting bail comprising a lift eye plate adapted to be located substantially near the machine center of gravity; a first locator member having first means for locating lift eye plate substantially near the machine center of gravity; a second locator member having second means for locating the lift eye plate substantially near the machine center of gravity, the first and second means for locating the lift eye plate relative to the center of gravity being oriented along the first and second locator members so that when the first and second locator members are made integral with the machine, the first and second indicator means are aligned and thereby provide the location for the lift eye plate substantially near the machine center of gravity.

Additional applications for the lifting bail disclosed here will be apparent to those skilled in the art in view of the disclosure and the more detailed description of certain preferred embodiments provided below.

DESCRIPTION OF THE DRAWING FIGURES

DESCRIPTION OF THE PREFERRED EMBODIMENT

Figure 1:
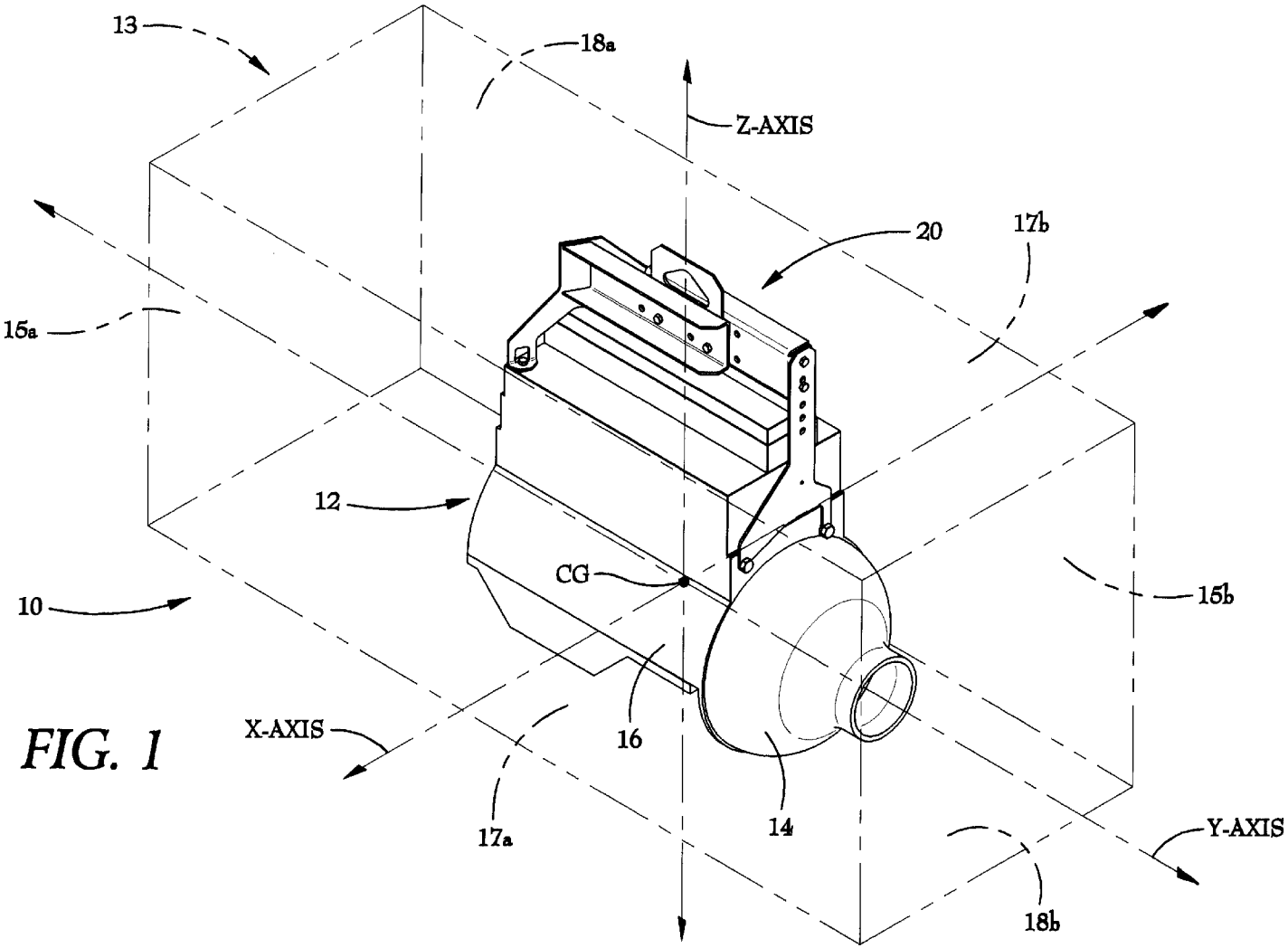
FIG. 1 is schematic representation of a fluid compressor with an airend flow connected to a prime mover with the adjustable lifting bail of the present invention made integral with the prime mover.

Now turning to the drawing Figures wherein like parts are referred to by the same number in all the drawing Figures, fluid compressor identified generally as 10 in FIG. 1, includes a compression module 12 that is housed in an enclosure 13 shown in dashed font in FIG. 1. The enclosure 13 includes six panels: side panels 15*a*, 15*b*, 17*a*, and 17*b*; and top and bottom panels 18*a*, and 18*b*. The panels define respective panel planes and also together define an enclosure chamber.

The compression module 12 generally includes an airend 14 that is directly driven by a prime mover 16. The airend is of the type well known to one skilled in the art and is comprised of male and female interengaging rotors (not shown) which compress a fluid such as air, as they are rotated by the prime mover. The prime mover 16 may be any suitable motor or engine including, but not limited to, diesel engines, electric engines, and internal combustion engines.

The compression module is fixed to a support frame (not shown) located within the enclosure chamber.

The lifting bail 20 of the present invention is made integral with prime mover 16 and is typically used to lift or otherwise move the compressor 10 during assembly and shipment. By connecting the lifting bail directly to the prime mover, movement of the compressor 10 is supported directly through the prime mover.

Referring to FIG. 1, the fluid compressor 10 has a center of gravity identified as CG, and the CG of the compressor 10 may be described in terms of spatial coordinates along the x, y, and z axes shown in FIG. 1. As the description proceeds, the x,y,and z axes may be referred to as depth, length, and height dimensions respectively. The x, y, and z axes are not part of the invention and are used to describe the location of the lifting bail relative to the compressor center of gravity.

Every machine or compressor has a center of gravity which may be defined by coordinates x,y,and z. Once the CG of the compressor 10 is determined by a technician or engineer analytically, the lifting bail 20 is made integral with the prime mover so that the lift eye plate 22 is located at center of gravity coordinates x and y and above the z coordinate of the center of gravity as shown in FIG. 1. The length or "y" dimension of the lifting bail 20 may be adjusted by a technician or other person skilled in the art to locate the lift eye plate 22 above a predetermined CG and thereby permit the single lifting bail 20 to be utilized in combination with a number of compressors that are different dimensionally and in their weight.

Figure 3:
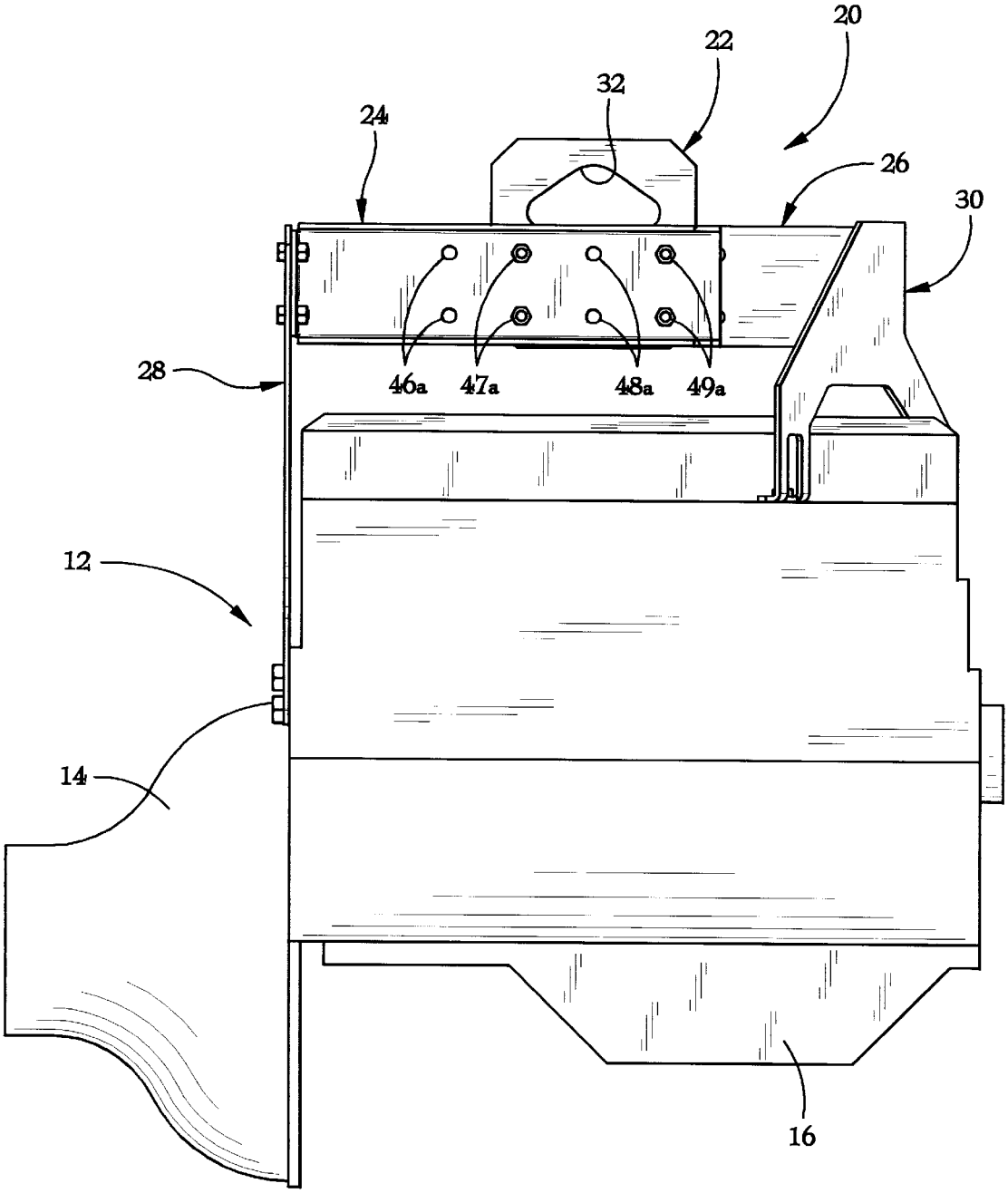
FIG. 3 is a side elevational view of the assembled lifting bail made integral with the prime mover of FIG. 2 showing the lifting bail in a first position.
Figure 9:
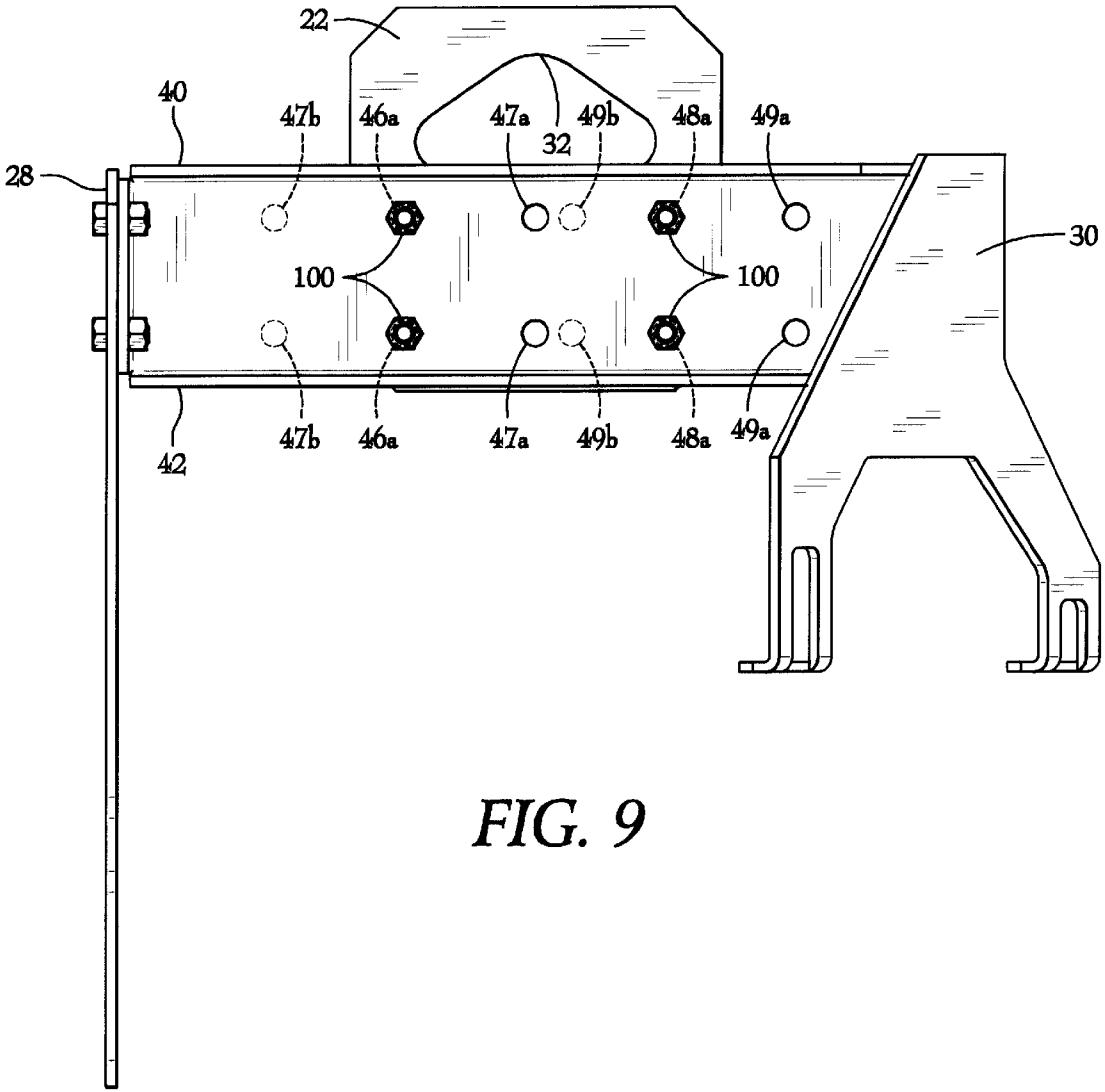
FIG. 9 is an elevational view of the lifting bail shown in FIG. 2 with the lifting bail in a second position.

FIGS. 3 and 9 illustrate different configurations of the lifting bail. In FIG. 3, the lifting bail of the present invention is shown in a first extended position which locates the lift eye plate 22 above the center of gravity for a first machine having a first center of gravity, and the retracted lifting bail of FIG. 9 locates the lift eye plate above a second center of gravity associated with a second machine. Additional positions may be included in lifting bail 20 to accommodate centers of gravity for other machines. In all instances, the lifting bail 20 of the present invention locates the lift eye plate substantially near the CG of the compressor 10.

Since at least one of the dimensions of lifting bail 20 may be adjusted as required to locate the lift eye at the required position, the lifting bail 20, among other things, overcomes the single use limitation associated with conventional lifting bails. It should be understood that although lifting bail 20 as disclosed provides for adjustment of the length or "y" dimension of the lifting bail to locate the lift eye plate in the required position, in an alternate embodiment, any of the dimensions of the lifting bail may be adjusted. Additionally, although the lifting bail is disclosed in combination with fluid compressor 10, the lifting bail of the present invention may be used in combination with any machine.

Now turning to FIGS. 4–8 which illustrate each of the component parts of the lifting bail 20 of the present invention, the lifting bail includes lift eye plate 22 that is located between first and second lift eye plate locator members 24 and 26; first lifting bail anchor member 28 that is made integral with first lift eye plate locator member 24; and second lifting bail anchor member 30 that is made integral with second lift eye plate locator member 26. The first and second anchor members 28 and 30 in turn are directly connected to the prime mover by bolts or other conventional fasteners, as shown in FIG. 3. All of the components 22–30 of lifting bail 20 are preferably made from steel however the lifting bail components may be made from any suitable material.

Figure 5:
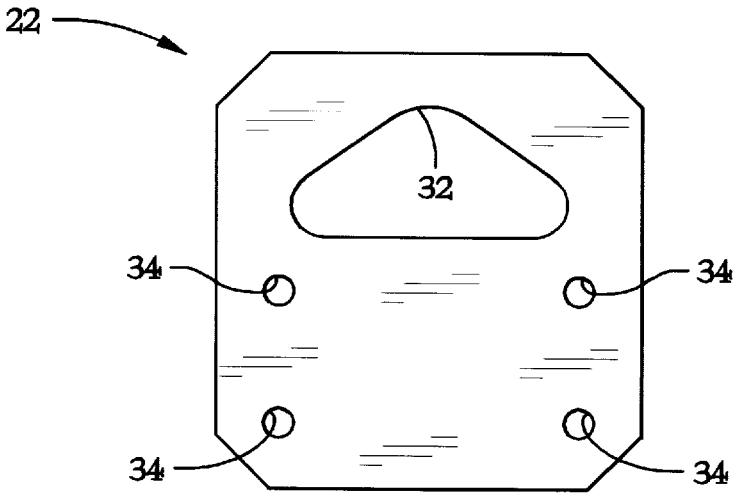
FIG. 5 is an elevational view of the lifting bail lift eye plate shown in FIG. 2.

Turning to FIG. 5, unitary lift eye plate 22 is substantially rectangular with chamfered corners. Lifting aperture 32 is a provided in eye plate 22 and is adapted to receive a hook or other member used to lift the compressor 10. The triangular shape of aperture 32 permits the size of the eye plate 22 to be minimized so that the entire eye plate 22 is located below enclosure top panel 18*a*, completely within the compressor enclosure 13 shown in FIG. 1.

Conventional compressor lifting bails protrude through an opening in the enclosure top panel and such an opening allows dirt, liquid and other undesirable matter to relocate inside the enclosure where it can negatively affect performance of the compressor. A plurality of alignment openings 34 extend through the plate 22 and allow the lift eye plate to be located accurately between the first and second locator members 24 and 26. As shown in FIG. 5, four alignment openings are provided in the lift eye plate however, it should be understood that lift eye plate 22 may include any suitable number of alignment openings 34.

Figure 2:
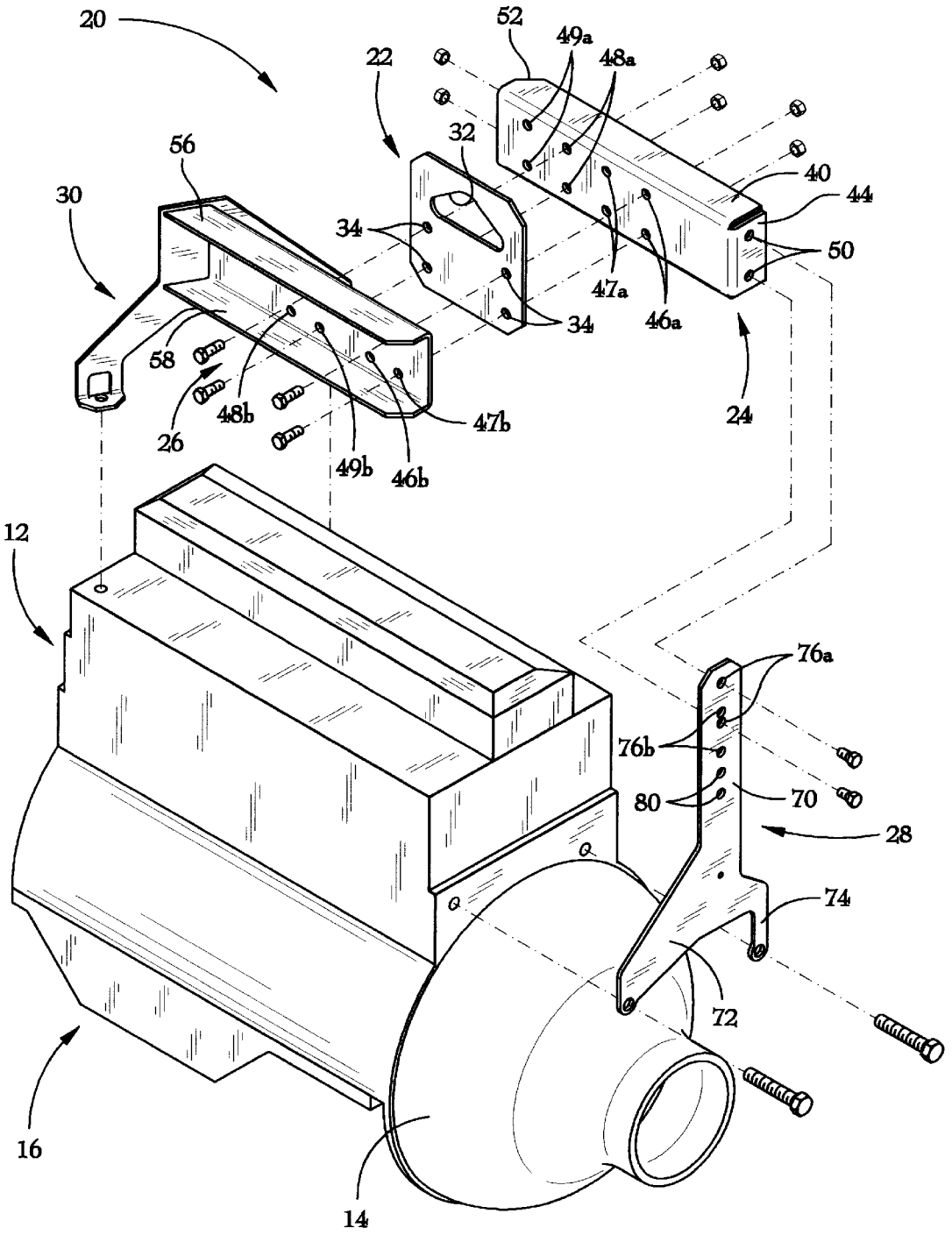
FIG. 2 is an isometric view of the prime mover of FIG. 1 with the lifting bail of the present invention shown as an exploded assembly.
Figure 6:
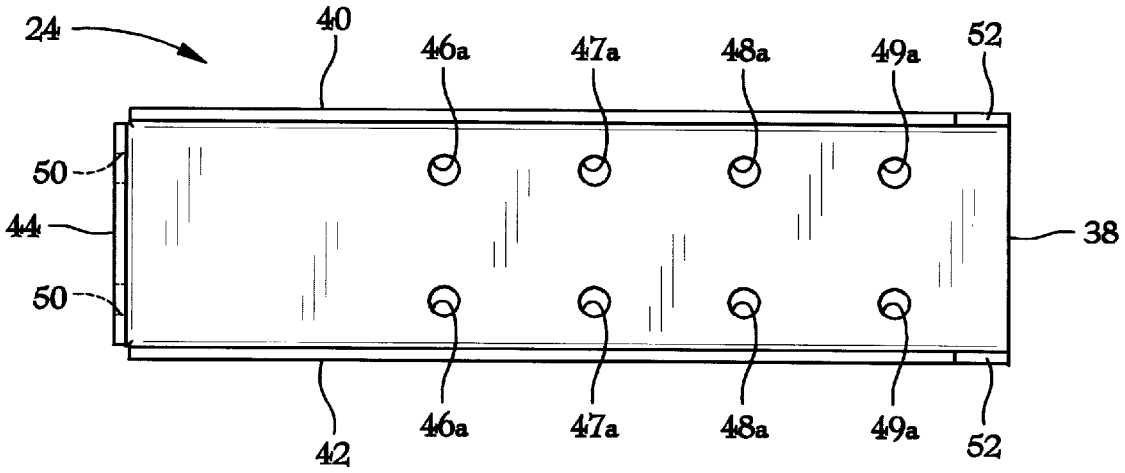
FIG. 6 is an elevational view of the first lift eye plate locator member shown in FIG. 2.

Now turning to FIG. 6, unitary first eye plate locator member 24 has a locator side 38 with longitudinally extending sides 40 and 42 and lateral side 44 extending between adjacent edges of sides 40 and 42 as shown in FIGS. 2 and 6. The sides 40, 42, and 44 are perpendicular to the locator side 38. First locator openings 46*a*, 47*a*, 48*a* and 49*a* extend through locator side 38, and a pair of openings 50 extend through side 44. Each side 40 and 42 includes an angled lateral edge 52 which prevents interference with second anchor member 30 when the lifting bail is in the second, retracted position shown in FIG. 9.

Figure 7:
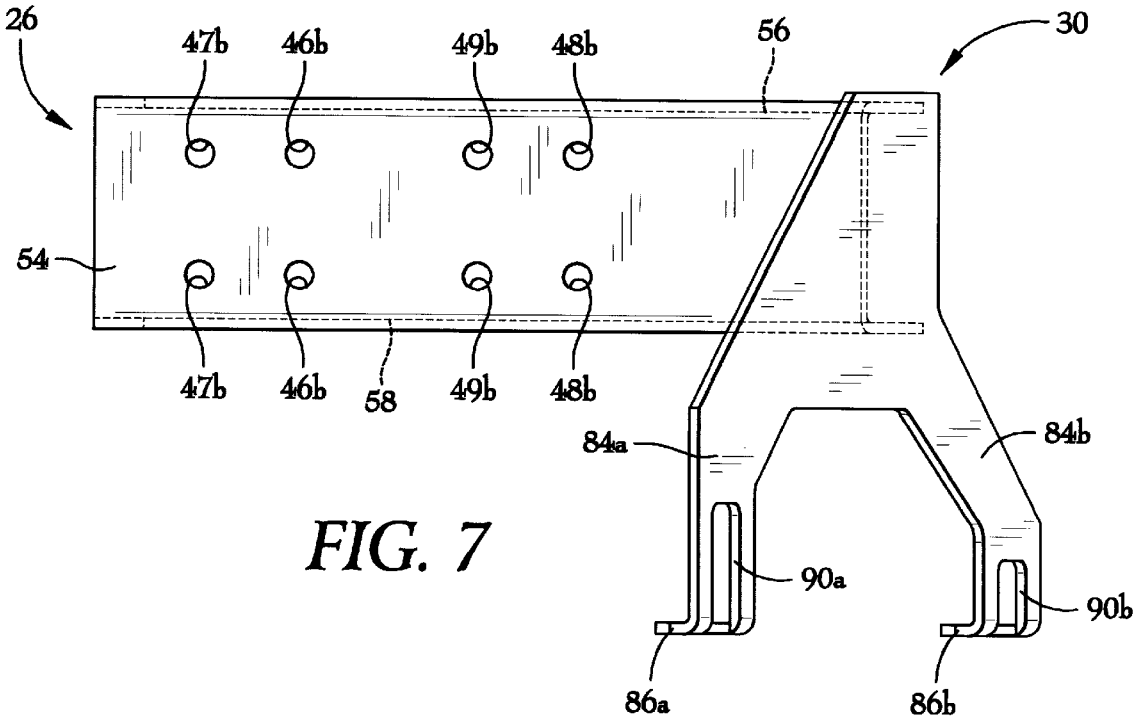
FIG. 7 is an elevational view of the second lift eye plate locator member with the second lifting bail anchor member made integral with the second lift eye plate locator member, as shown in FIG. 2.
Figure 8:
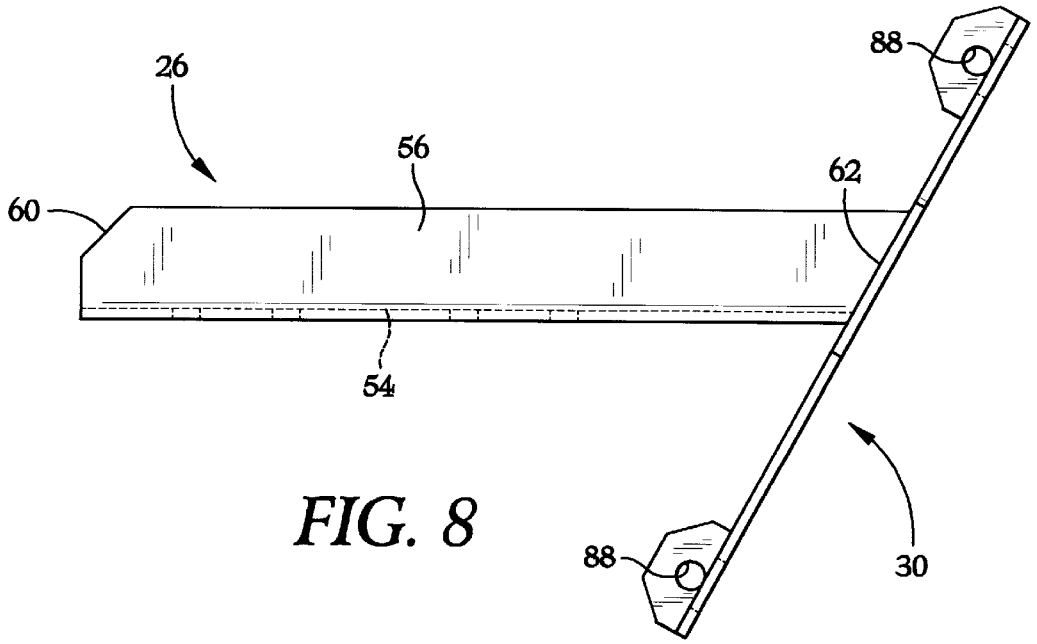
FIG. 8 is a top view of the second anchor member and locator member of FIG. 7.

The unitary second eye plate locator member 26 shown in FIGS. 2, 7 and 8 includes a longitudinal locator side 54, like longitudinal side 38 of first locator member 24. Locator side 54 includes locator openings 46*b*, 47*b*, 48*b*, and 49*b* which align with corresponding openings 46*a*, 47*a*, 48*a*, and 49*a* when the members 24 and 26 are in substantially near the CG of compressor 10. The locator openings 46*a,b*; 47*a,b*; 48*a,b*; and 49*a,b* are located in the required positions along respective locator sides so that the paired corresponding openings are in alignment when the lifting bail in extended and retracted to the required position. Longitudinal sides 56 and 58 extend away from and are perpendicular to side 54. The sides 56 and 58 include chamfers 60 as shown in FIG. 8 and also have angled lateral edges 62. The second anchor member 30 is welded or otherwise made integral with lateral edges 62, and as a result, is oriented at an angle relative to side 54.

The openings 46*a,b*; 47*a,b*; 48*a,b*; and 49*a,b* are located along respective locator members so that when the locator members are in the first extended position of FIG. 3, only openings 47*a,b* and 49*a,b* are in alignment; and when the locator members are in the second,retracted position of FIG. 9, only openings 46*a,b* and 48*a,b* are in alignment. The openings 46*a*–49*a* and 46*b*–49*b* are disclosed for purposes of describing the preferred embodiment of the invention and it should be understood that any number of openings in any location may be provided along locator sides 54 and 38. Based on the application and use of lifting bail 20, it was determined through experimentation that the disclosed number of openings on the sides 38 and 54 at the disclosed locations were required. The corresponding pairs of openings on members 24 and 26 only are aligned when the members are in the required extended and retracted positions in FIGS. 3 and 9.

Figure 4:
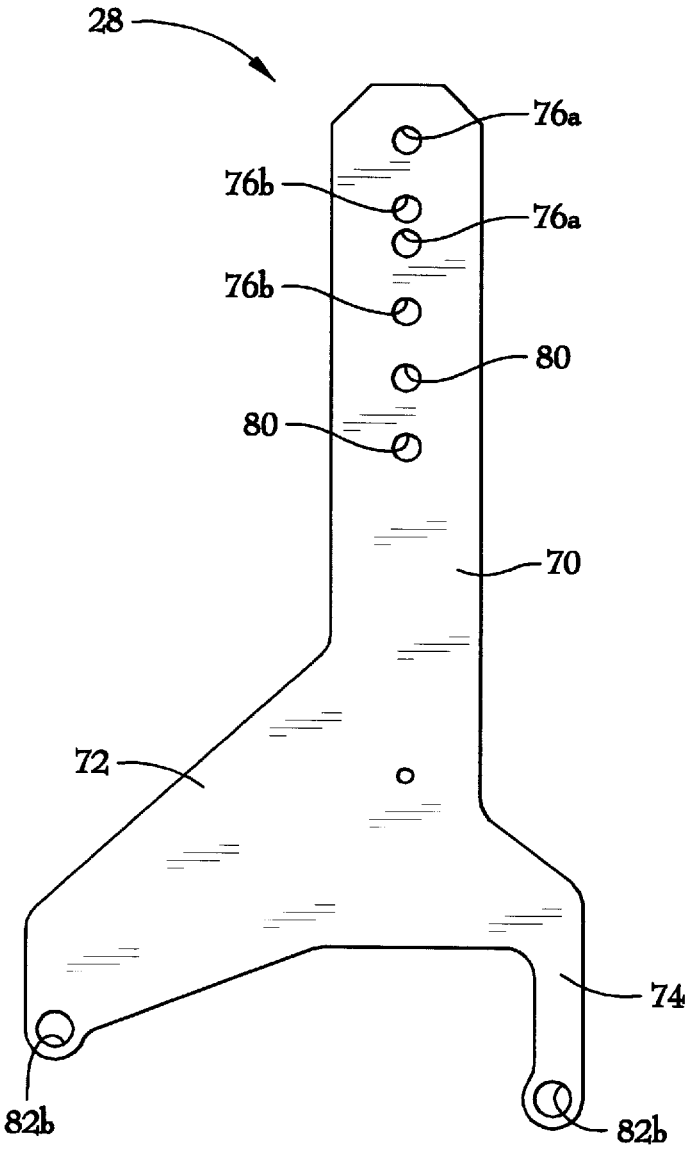
FIG. 4 is an elevational view of the first lifting bail anchor member shown in FIG. 2.

Unitary first lifting bail anchor member 28 illustrated in FIG. 4 includes an upward extending tongue 70 and a pair of downward extending legs 72 and 74. A plurality of aligned openings 76*a* and 76*b* are spaced along tongue 70. The openings are arranged in a laterally extending line, and the pairs of openings 76*a*, and 76*b* may be aligned with openings 50 on lateral side 44 openings to permit the anchor and locator member to be connected by a bolt or other connection member.

Openings 80 located below openings 76*b*, allow the first anchor member to be attached to the prime mover 16, and as a result of such connection, the co-inventors have determined that the lifting bail can support loads equal to seven times the weight of the compressor. Primary connection to the prime mover is achieved by passing bolts or other connection members through apertures 82*a* and 82*b* provided in legs 72 and 74 respectively.

Second lifting bail anchor member 30 is welded to the angled edges 62 of second lift eye plate locator member 26, as shown in FIGS. 7 and 8. The unitary anchor member 30 has a pair of legs 84*a* and 84*b* and feet 86*a* and 86*b* at the ends of the legs. The feet are located on the prime mover and bolts or other suitable fasteners are passed through openings 88 in the feet to thereby connect the second anchor member 30 to the prime mover 16. Slots 90*a* and 90*b* are provided in the legs 84*a* and 84*b* to permit a tool or other member to access the bolt as required.

Use of lifting bail 20 will now be described. After determining the compressor model to be assembled and the corresponding CG, the lifting bail 20 is anchored to the compressor prime mover. The first locator member 24 is connected to the first anchor member 28. The second anchor member 30 is welded or otherwise made integral with the second locator member. Then, combination first locator/anchor member and the combination second locator/anchor member are connected to the prime mover. Alternatively, the first anchor member 28 may be connected to the prime mover first and then the first locator member may be connected to the first anchor member.

If the dimensions and weight of the compressor require the lifting bail to be retracted to locate the plate 22 in the correct position, the locator members and anchor members are first fastened to the compressor prime mover 16 by conventional fasteners and the corresponding locator member openings 46*a,b* and 48*a,b* are aligned when the locator and anchor members are anchored to the prime movers. Then lift eye plate 22 is located between retracted locator members 24 and 26 so that openings 34 are aligned with openings 46*a* and 48*a* as shown in FIG. 9. For a first model compressor, openings 47*a,b* and 49*a,b* are not aligned. Therefore, a technician can not mistakenly locate the lift eye plate in the incorrect position. Bolts or other fasteners 100 are passed through aligned openings 34, 46*a,b* and 49*a,b* and the lifting bail is then properly positioned substantially near the CG of compressor 10.

Based on the dimensions and weight of the compressor, it may be necessary to extend the lifting bail to locate the lift eye plate at or substantially near the CG. In such a situation, after anchor members 28 and 30 are bolted to the prime mover in the manner previously described, the lift eye plate 22 is inserted between members 24 and 26 and openings 34 are aligned with openings 47*a* and 47*b* and 49*a* and 49*b* and bolts 100 are inserted through the aligned openings. In the extended position of FIG. 3, openings 46*a,b* and 48*a,b* are not aligned.

While a particular embodiment of this invention has been shown and described, it is not intended to limit the same to the details of construction set forth, but instead, the invention embraces such changes, modifications and equivalents of the various parts and their relationships as come within the purview of the following claims.

Having described the invention what is claimed is:

1. A lifting bail adapted to be made integral with a machine having a center of gravity, the lifting bail comprising:

A) a lift eye plate adapted to be located substantially near the machine center of gravity;

B) a first locator member having first means for locating the lift eye plate substantially near the machine center of gravity;

C) a second locator member having second means for locating the lift eye plate substantially near the machine center of gravity, the lift eye plate being in contact with the first and second locator members, the first and second means for locating the lift eye plate relative to the center of gravity being oriented along the first and second locator members to that when the first and second locator members are made integral with the machine, the first and second means for locating the lift eye plate being in a first aligned position so as to provide the location for the lift eye plate substantially near the machine center of gravity.

2. The lifting bail as claimed in claim 1 wherein the first locator member includes a first locator side, and wherein said first locator means is comprised of a plurality of openings along the first locator side.

3. The lifting bail as claimed in claim 2 wherein the second locator means includes a second locator side, and wherein said second locator means is comprised of a plurality of openings along the second locator side.

4. The lifting bail as claimed in claim 3 wherein the second locator means is comprised of first, second, third, and fourth pairs of openings located side-by-side.

5. The lifting bail as claimed in claim 4 wherein the first locator means is comprised of first, second, third, and fourth pairs of openings located side-by-side, first and second pairs of openings of the first locator means adapted to be in alignment with first and second pairs of openings of the second locator means when the locator members are in the first aligned position.

6. The lifting bail as claimed in claim 5 wherein the first and second locator means are adapted to be made integral with the machine so that the locator members are located in a second aligned position with third and fourth pairs of openings of the first locator means in alignment with third and fourth openings of the second locator means.

7. The lifting bail claimed in claim 6, wherein the lift eye plate includes lift plate locator means adapted to be in alignment with the first and second locator means when the locator means are in the first or second positions.

8. The combination as claimed in claim 7 wherein the lift plate locator means is comprised of a plurality of openings.

9. The lifting bail as claimed in claim 8 wherein the lift plate locator means is comprised of four openings, arranged in two side-by-side pairs.

10. The lifting bail as claimed in claim 1 wherein the lift eye plate is located between the first and second locator members.

11. The lifting bail as claimed in claim 10 wherein the lift eye plate includes a hook aperture.

12. The lifting bail as claimed in claim 11 wherein the hook aperture is substantially triangular.

13. The lifting bail as claimed in claim 1 wherein the machine is a fluid compressor.

14. The lifting bail as claimed in claim 1 wherein the lifting bail is made integral with the machine by a first anchor member connected to the first locator member and a second anchor member made integral with the second locator member.

* * * * *